US011566608B2

(12) United States Patent
Steele

(10) Patent No.: US 11,566,608 B2
(45) Date of Patent: Jan. 31, 2023

(54) AQUACYCLE PUMP AND METHOD OF USE

(71) Applicant: Planet Water, LLC, Scottsdale, AZ (US)

(72) Inventor: Mark A. Steele, Phoenix, AZ (US)

(73) Assignee: Planet Water, LLC, Scottsdale, AZ (US)

( * ) Notice: Subject to any disclaimer, the term of this patent is extended or adjusted under 35 U.S.C. 154(b) by 415 days.

(21) Appl. No.: 16/560,789

(22) Filed: Sep. 4, 2019

(65) Prior Publication Data

US 2021/0062813 A1 Mar. 4, 2021

(51) Int. Cl.

| | |
|---|---|
| ***F04B 17/05*** | (2006.01) |
| ***F04D 13/02*** | (2006.01) |
| ***F04D 29/62*** | (2006.01) |
| ***F02B 63/06*** | (2006.01) |

(52) U.S. Cl.

CPC ..... *F04B 17/05* (2013.01); *F04D 13/021* (2013.01); *F04D 29/628* (2013.01); *F02B 63/06* (2013.01)

(58) Field of Classification Search

CPC ..... F02B 63/06; F04B 17/05; A63B 69/16; A63B 2069/161; A63B 2069/163–167; F04D 13/021; F04D 29/628

USPC ..... 417/231, 233

See application file for complete search history.

(56) References Cited

U.S. PATENT DOCUMENTS

| | | | | |
|---|---|---|---|---|
| 1,169,705 A * | 1/1916 | Wilkes | B60C 23/127 | 152/421 |
| 1,376,718 A * | 5/1921 | Mohney | B60C 23/129 | 417/233 |
| 2,972,478 A * | 2/1961 | Raines | A63B 69/16 | 482/61 |
| 3,201,121 A * | 8/1965 | Locke | A63B 69/16 | 482/61 |
| 3,494,616 A * | 2/1970 | Parsons | A63B 22/0605 | 482/58 |

(Continued)

*Primary Examiner* — Alexander B Comley

(74) *Attorney, Agent, or Firm* — McGrath North Mullin & Kratz, PC LLO; Luke C. Holst

(57) ABSTRACT

The present invention relates in general to the field of water pumps, and more specifically, to an attachment configured to connect to the rear wheel of a motorcycle or motorscooter to provide power to a water pump and a method of pumping water using the attachment. One aspect of the aquacycle pump includes a base plate and a kick-stand support bracket configured to slidably adjust so that the aquacycle pump may be compatible with different sizes of motorcycles or motorscooters. The aquacycle pump may further include a roller that is configured to abut against the rear wheel of the motorcycle or motorscooter. The aquacycle pump may further include a water pump, wherein the water pump is connected to the roller. The aquacycle pump is configured such that as the engine of the motorcycle or motorscooter is started and power is provided to rotate its rear wheel, the abutting roller of the aquacycle pump also rotates. The rotation of the roller, in turn, operates the water pump to convey water to a location where water is needed. The purpose of the invention is to provide a device and method that may utilize existing motorized vehicles prevalent in developing countries (e.g., motorcycles, motorscooters), instead of electricity or petrol generators, to provide energy to a water pump for delivering water.

19 Claims, 4 Drawing Sheets

(56) References Cited

U.S. PATENT DOCUMENTS 3,526,042 A * 9/1970 Nelson ..... G01M 17/0076 434/61
3,686,776 A * 8/1972 Dahl ..... G09B 9/058 434/61
4,082,264 A * 4/1978 Santos ..... A63B 21/0085 482/112
4,580,983 A * 4/1986 Cassini ..... A63B 22/16 280/293
4,768,782 A * 9/1988 Blackburn ..... A63B 69/16 482/59
4,969,642 A * 11/1990 Phillips ..... A63B 69/16 434/61
5,010,763 A * 4/1991 Schneider ..... G01M 17/0076 73/116.09
5,318,317 A * 6/1994 Hopper ..... B60C 23/105 152/416
5,397,144 A * 3/1995 Mirand ..... B60C 23/105 152/416
5,472,392 A * 12/1995 Haan ..... A63B 21/015 188/78
6,620,081 B2 * 9/2003 Phillips ..... A63B 21/015 482/57
6,910,992 B2 * 6/2005 Arguilez ..... A63B 21/285 482/57
8,439,808 B2 * 5/2013 Hamilton ..... A63B 69/16 482/61
9,381,396 B2 * 7/2016 Colan ..... A63B 21/0051
9,433,820 B1 * 9/2016 Martinez ..... A63B 69/16
9,539,466 B1 * 1/2017 Schoner ..... A63B 23/0476
2016/0158620 A1 * 6/2016 Bauer ..... A63B 24/0087 482/61
2018/0200599 A1 * 7/2018 Lugton ..... A63B 69/16

* cited by examiner

AQUACYCLE PUMP AND METHOD OF USE

FIELD OF THE INVENTION

The present invention relates in general to the field of water pumps, and more specifically, to an attachment for a water pump configured to connect to the rear wheel of a motorcycle or motorscooter to provide power to the water pump and a method of pumping water using the attachment. The purpose of the invention is to provide an attachment and method that may utilize existing motorized vehicles prevalent in developing countries (e.g., motorcycles, motorscooters) to provide energy to the water pump for conveying water. Thus, water may be delivered in developing countries that often lack the basic resources necessary to power a water pump, such as electricity or a petrol generator. An additional purpose of the invention is to provide a rugged device that is cost-efficient to manufacture, inexpensive to purchase, easy to operate and convenient to store.

BACKGROUND OF THE INVENTION

Clean, accessible water is vital to human health. Unfortunately, over 40% of the global population does not have access to clean water. According to the United Nations, about 4 billion people, representing nearly two-thirds of the world population, experience severe water scarcity during at least one month of the year. *Water Scarcity*, UN-Water (July, 2019), available at https://www.unwater.org/water-facts/scarcity/. Developing countries are most affected by water shortages and poor water quality. Indeed, the Global Water Institute has determined that in developing countries the lack of clean water and sanitation are the source of health problems for almost half of the population and can be linked to 80% of disease. Elizabeth Hameeteman, *Future Water (IN)Security: Facts, Figures, and Predictions*, Global Water Institute (2013).

In many of these developing countries, particularly in rural areas, households don't have accessibility to electricity or the resources needed to purchase and maintain petrol generators for operating a water pump. Despite this fact, the number of private vehicles—namely motorcycles and motorscooters—is increasing in almost all developing countries. For example close to 80% of households in Delhi, India have motor vehicles, most of them two-wheelers. The reason for this astonishing figure is that motorcycles and motorscooters may cost as little as $200 in developing countries. At such low costs families no longer have to accumulate considerable savings to own a vehicle. Indeed, motorcycles and motorscooters are the lifeblood of millions of individuals and small businesses in developing countries, transporting families, farm products and locally manufactured goods on a daily basis.

Thus, a desire remains to provide access to water in developing countries where electricity and petrol generators are scarce or cost-prohibitive. A desire also remains to use existing motorized devices common in such developing countries, such as motorcycles or motorscooters, as a power source for delivering water in a convenient and cost-efficient manner.

BRIEF SUMMARY OF THE INVENTION

Therefore, it is a principal object, feature, and/or advantage of the present disclosure to overcome the aforementioned deficiencies in the art and provide an attachment for a water pump that is configured to connect to the rear wheel of a motorcycle or motorscooter to provide power to the water pump and a method of pumping water using the attachment.

Another object, feature, and/or advantage of the present disclosure is to provide an attachment for a water pump and method of pumping water that doesn't require electricity or a petrol generator.

Yet another object, feature, and/or advantage of the present disclosure is to provide an attachment for a water pump and method of pumping water that is rugged, reliable and able to endure harsh environmental conditions.

A further object, feature, and/or advantage of the present disclosure is to provide an attachment for a water pump and method of pumping water that maximizes efficiency, is easy to operate and convenient to store.

A still further object, feature, and/or advantage of the present disclosure is to provide an attachment for a water pump and method of pumping water that is easy to clean and maintain.

Another object, feature, and/or advantage of the present disclosure is to provide an attachment for a water pump and method of pumping water that is adjustable in length to accommodate varying heights and sizes of motorcycles and motorscooters.

Yet another object, feature, and/or advantage of the present disclosure is to provide an attachment for a water pump and method of pumping water that may be used with any make, model or manufacture of motorcycles and motorscooters.

A further object, feature, and/or advantage of the present disclosure is to provide an attachment for a water pump and method of pumping water that is cost-efficient to manufacture, inexpensive to purchase, and affordable in developing countries.

A still further object, feature, and/or advantage of the present disclosure is to provide an attachment for a water pump and method of pumping water that is environmentally-friendly and that reduces unnecessary waste.

These and/or other objects, features, and/or advantages of the present disclosure will be apparent to those skilled in the art. The present disclosure is not to be limited to or by these objects, features, and advantages. No single aspect need provide each and every object, feature, or advantage.

According to one aspect of the present disclosure, an aquacycle pump is provided. The aquacycle pump comprises an attachment configured to connect to the rear wheel of a motorcycle or motorscooter. The attachment may include a base plate and a kick-stand support bracket configured to slidably adjust so that the aquacycle pump may be compatible with different sizes of motorcycles or motorscooters. The attachment may further include a roller that is configured to abut against the rear wheel of the motorcycle or motorscooter. The attachment may further include a water pump, wherein the water pump is connected to the roller. The attachment is configured such that as the engine of the motorcycle or motorscooter is started and power is provided to rotate its rear wheel, the abutting roller of the aquacycle pump also rotates. The rotation of the roller, in turn, operates the water pump to convey water to a location where water is needed.

According to another aspect of the present disclosure, a method of pumping water using an aquacycle pump is provided. The method includes providing the aquacycle pump. The method further includes providing a water source and a location where water is needed. A motorcycle or motorscooter may also be provided. The kick-stand support bracket of the aquacycle pump may be adjusted to fit the size of the motorcycle or motorscooter. The method also includes placing a rear wheel of the motorcycle or motorscooter in contact with the roller of the aquacycle pump and throttling the engine to provide power to rotate the rear wheel. The kick-stand support bracket may be locked in position to maintain contact between the roller of the aquacycle pump and the rear wheel the motorcycle or motorscooter and to prevent movement of the motorcycle or motorscooter during operation of the aquacycle pump. As the rear wheel rotates, traction between the rear wheel and the roller also causes the roller to rotate. Rotating the roller operates the water pump of the aquacycle pump to convey the water to the location where water is needed.

Different aspects may meet different objects of the disclosure. Other objectives and advantages of this disclosure will be more apparent in the following detailed description taken us conjunction with the figures. The present disclosure is not to be limited by or to these objects or aspects. It is to be understood that both the foregoing general description and the following detailed description are exemplary and explanatory only and are not necessarily restrictive of the present disclosure. The accompanying figures, which are incorporated in and constitute a part of the specification, illustrate subject matter of the disclosure. Together, the descriptions and the figures serve to explain the principles of the disclosure.

DESCRIPTION OF FIGURES

FIG. 1 is an isometric front-top-right side view of the aquacycle pump of the present disclosure.

FIG. 2 is an isometric front-right side view of the aquacycle pump of FIG. 1 connected to a motorcycle or motorscooter.

FIG. 3 is a isometric top view of the aquacycle pump of FIG. 1.

FIG. 4 is a isometric front view of the aquacycle pump of FIG. 1.

FIG. 5 is a isometric right side view of the aquacycle pump of FIG. 1.

FIG. 6 is a isometric left side view of the aquacycle pump of FIG. 1.

FIG. 7 is a isometric front-top-left side view of the aquacycle pump of FIG. 1 in a retracted position.

FIG. 8 is a isometric front-top-left side view of the aquacycle pump of FIG. 1 in an expanded position.

DETAILED DESCRIPTION OF THE INVENTION

Figure 1:
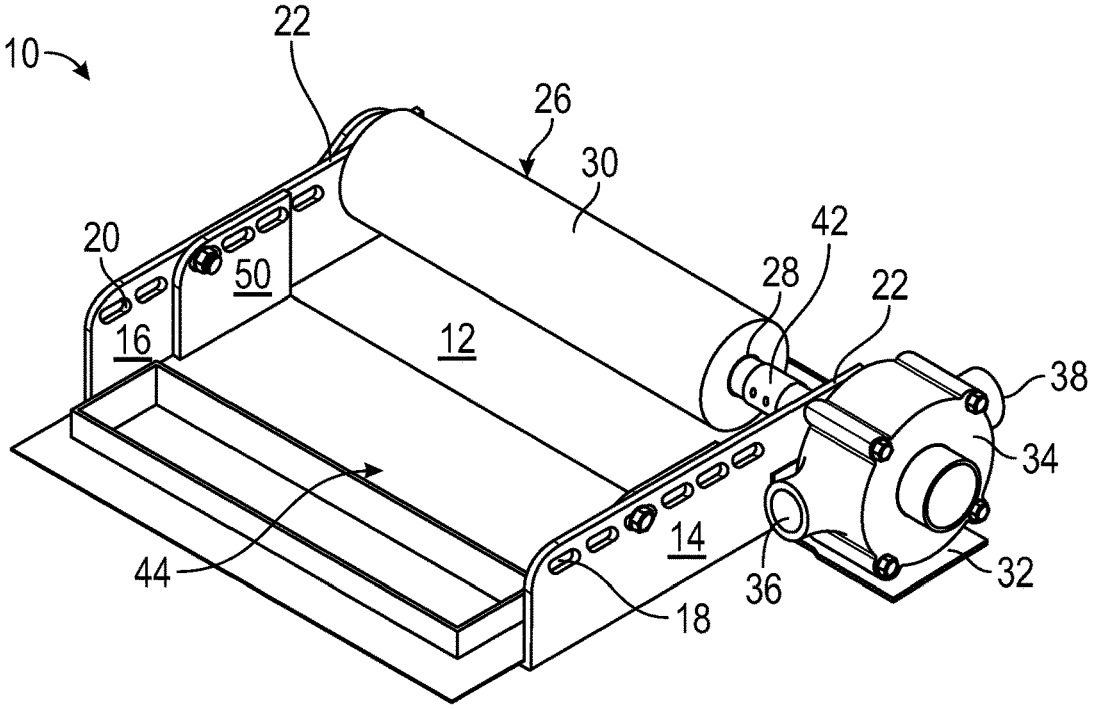
FIGS. 1-8 represent examples of an aquacycle pump of the present disclosure, and a method of pumping water using the aquacycle pump.

FIG. 1 illustrates an isometric front-top-right side view of one aspect of the aquacycle pump (10) of the present disclosure. In particular, the aquacycle pump (10) comprises a base plate (12) configured to be placed on the ground and other hard, flat surfaces. The base plate (12) may include a first side wall (14) and an opposite, second side wall (16). The first side wall (14) may have a series of openings (18) along a top portion of the first side wall (14). The second side wall (16) may also have a series of openings (20) along a top portion of the second side wall (16). The series of openings (18) of the first side wall (14) are configured to correspond to the series of openings (20) of the second side wall (16). The base plate (12) and first and second side walls (14, 16) may be integrally formed together during the manufacturing process, or alternatively, the base plate (12) and first and second side walls (14, 16) may be formed separately during the manufacturing process and then permanently or removably fixed together using welds, glues, screws, bolts, rivets, or other common means of attachment. It is contemplated that base plate (12) and first and second side walls (14, 16) of the aquacycle pump (10) may be comprised of steel, stainless steel, plastics, aluminum or combinations thereof.

Shown in FIG. 1, the first and second side walls (14, 16) of the base plate (12) may include a support bracket (22). The support bracket (22) may be formed integrally with the first and second side walls (14, 16) of the base plate (12). Thus, the support bracket (22) may also be comprised of steel, stainless steel, plastics, aluminum or combinations thereof.

Figure 2:
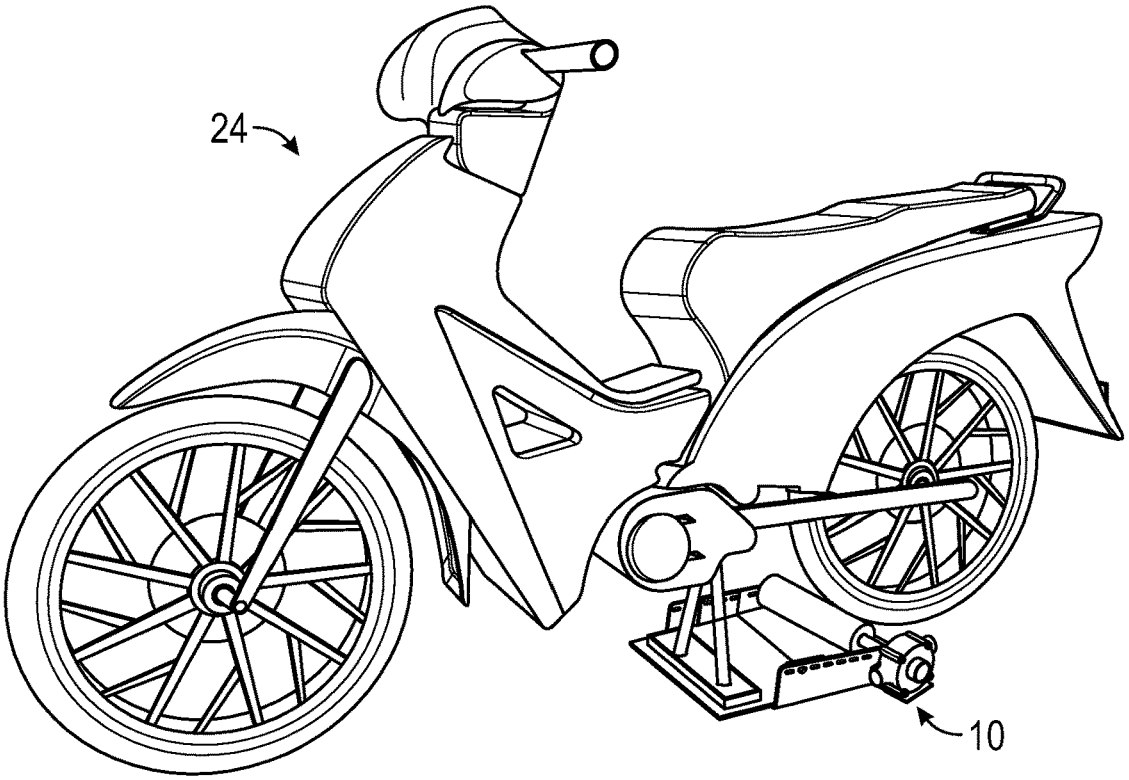

FIG. 2 illustrates the aquacycle pump (10) connected to a motorcycle or motorscooter (24). In particular, FIGS. 1-2 show that the support bracket (22) of the aquacycle pump (10) is configured to support a roller (26). The roller (26) is configured to be in contact a rear wheel of the motorcycle or motorscooter (24). In particular, the roller (26) may comprise an inner shaft (28) and an outer coating (30). The inner shaft (28) may be comprised of steel, stainless steel, plastics, aluminum or combinations thereof. The outer coating (30) may be a rubberized coating around the shaft (28), wherein the outer coating (30) is configured to be in contact with, abut against, and improve traction with a tire of the rear wheel of the motorcycle or motorscooter (24). The inner shaft (28) and the outer coating (30) may be permanently or removably adhered or affixed together, wherein the inner shaft (28) is configured to not move, slide, or rotate inside the outer coating (30). Therefore the inner shaft (28) and the outer coating (30) are configured to act and rotate together as a single unit.

Figure 3:
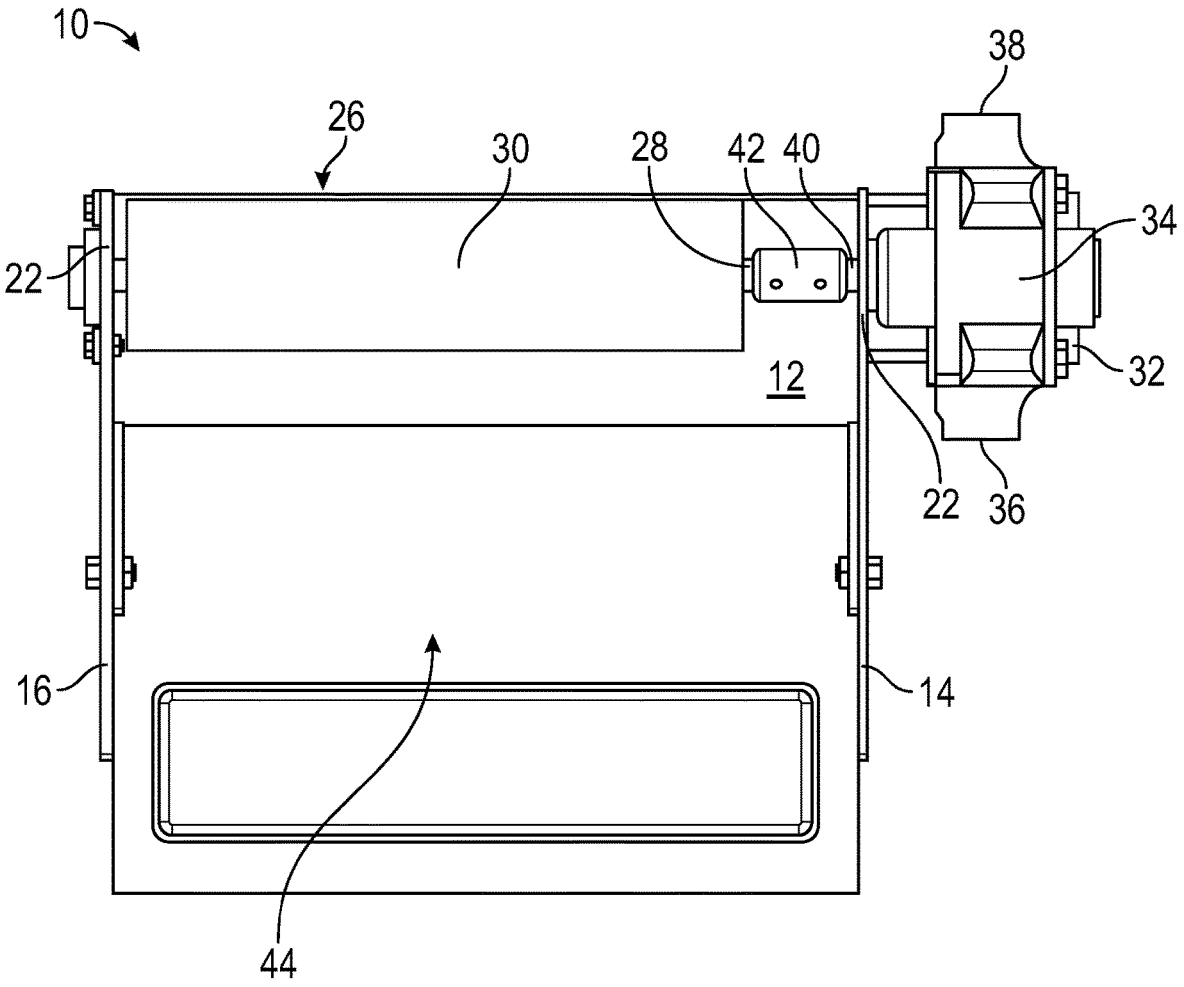

FIG. 3 illustrates an isometric top view of the aquacycle pump (10). In particular, FIGS. 1-3 show that the support bracket (22) may include holes configured such that the inner shaft (28) of the roller (26) traverses therethrough and rotates freely therein. The support bracket (22) may further comprise bearings to assist the inner shaft (28) in rotating freely in the holes of the support bracket (22), The roller (26) is configured such that as the rear Wheel of the motorcycle or motorscooter (24) rotates and is in contact with the adjacent outer coating (30) of the roller (26), the traction between the rear wheel and the outer coating (30) also causes the outer coating (30) to rotate. The rotation of the outer coating (30), in turn, further causes the inner shaft (28) to rotate freely in the support bracket (22) The outer coating (30) and the inner shaft (28) therefore are configured to act and rotate together as a single unit.

Figure 4:
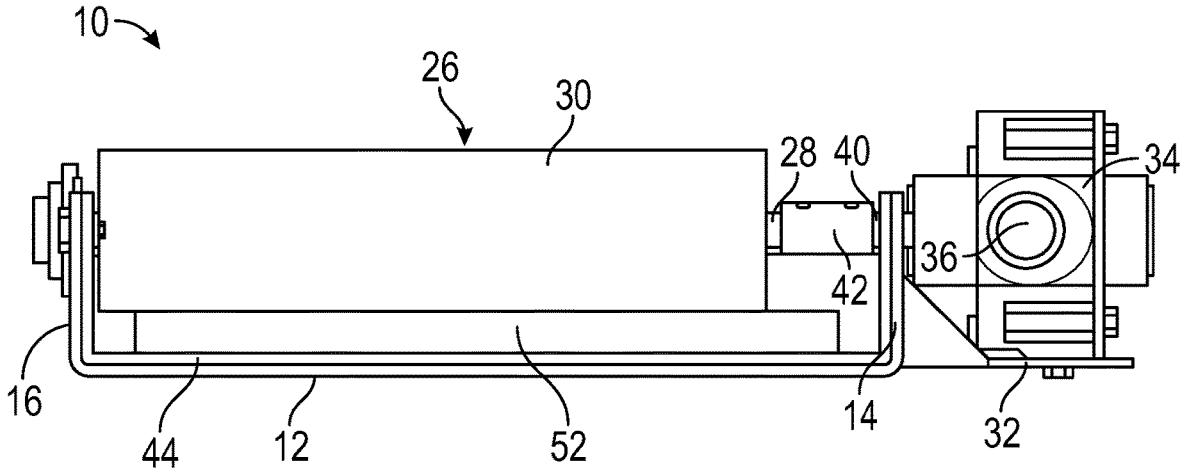

FIG. 4 illustrates an isometric rear view of the aquacycle pump (10). In particular, FIGS. 1-4 show that the aquacycle pump (10) may comprise a water pump support plate (32) and a water pump (34). The water pump support plate (32) may be configured to support the water pump (34) in a fixed position. In particular, the water pump support plate (32) may be integrally formed with the base plate (12) and/or the first or second side walls (14, 16) as one piece, or alternatively, the water pump support plate (32) may be permanently or removably attached to the base plate (12) and/or either the first or second side walls (14, 16) using welds, glues, screws, bolts, rivets, or other common means of attachment. It is contemplated that the water pump support plate (32) of the aquacycle pump (10) may be comprised of steel, stainless steel, plastics, aluminum or combinations thereof.

Further shown in FIGS. 1-4, the water pump (34) may comprise a centrifugal water pump or a positive displacement water pump (e.g., diaphragm, gear, lobe, peristaltic, or piston pinup). The water pump (34) may be removably attached to the water pump support plate (32) using screws, bolts, rivets, or other common means of removable attachment for an event Where the water pump (34) may need to be removed from the water pump support plate (32), repaired and/or replaced. The water pump (34) may include an inlet opening (36) for attaching an inlet hose and an outlet opening (38) for attaching an outlet hose for pumping and transferring water through the water pump (34), The water pump (34) may further comprise a water pump shaft (40) for operating the water pump (34).

Still farther shown in FIGS. 1-4, the water pump shaft (34) may be removably coupled to the inner shaft (42) of the roller (26) via a shaft coupler (42). For exemplary purposes only, the shaft coupler (42) may be a circular, hollow tube comprised of steel, stainless steel, plastics, aluminum or combinations thereof. It is contemplated that hollow tubes comprised of other tubular shapes (e.g., square, pentagon, hexagon, octagon, etc.) and materials may also be utilized. The shaft coupler (42) may further comprise at least two threaded holes traversing through a side wall of the hollow tube, and a corresponding screw or bolt configured to be inserted into and screwed through each threaded hole. The shaft coupler (42) may removably couple the water pump shaft (34) to the inner shaft (28) of the roller (26) by inserting a free end of the water pump shaft (34) into, an open end of the hollow tube and screwing a screw or bolt inside the threaded hole to press against the free end of the water pump shaft (34) in the hollow tube to effectively lock the free end of the water pump shaft (34) in the shaft coupler (42). Similarly, a free end of the inner shaft (42) of the roller (26) may be inserted into the remaining open end of the hollow tube, wherein a screw or bolt is screwed inside the threaded hole to press against the free end of the of the inner shaft (42) in the hollow tube to effectively lock the free end of the of the inner shaft (42) in the shaft coupler (42). It is to be understood that shaft coupler (42) described above is merely illustrative and are not intended to confine the scope of the present disclosure, as it is intended that other means of removably coupling the water pump shaft (34) to the inner shaft (42) of the roller (26) may also be utilized, such as via screws, bobs, interlocking joints, threaded pieces, or other means of removable coupling. As the wheel of the motorcycle or motorscooter (24) in contact with the roller (26) rotates, this in turn causes the roller (26) to rotate the inner shaft (28) and the water pump shaft (40) coupled together via the shaft coupler (42). The rotating water pump shaft (40) operates the water pump (34) of the aquacycle pump (10) to convey the water to the location where water is needed.

Figure 5:
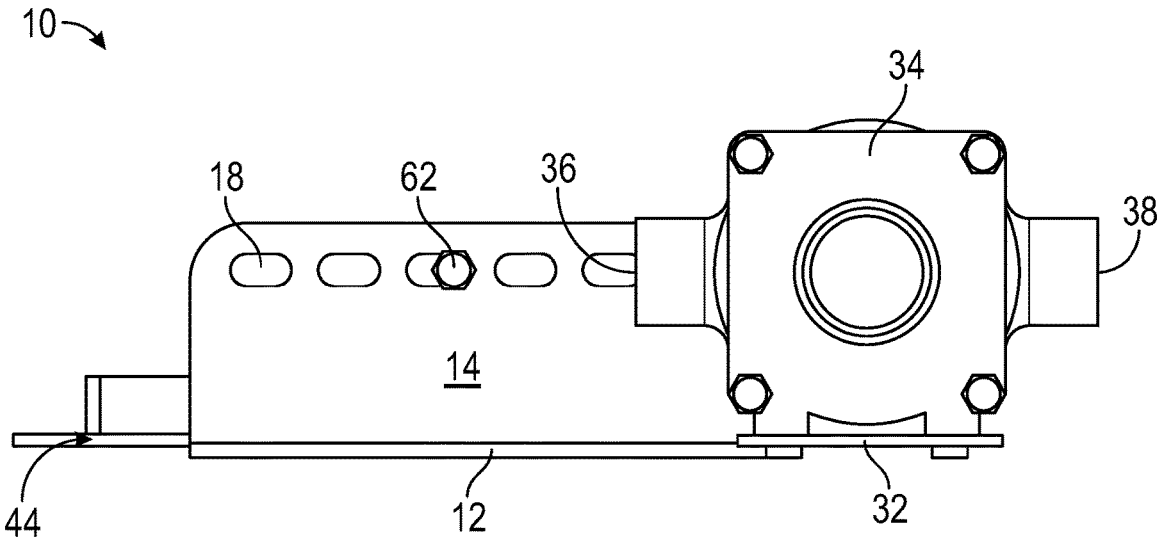
Figure 6:
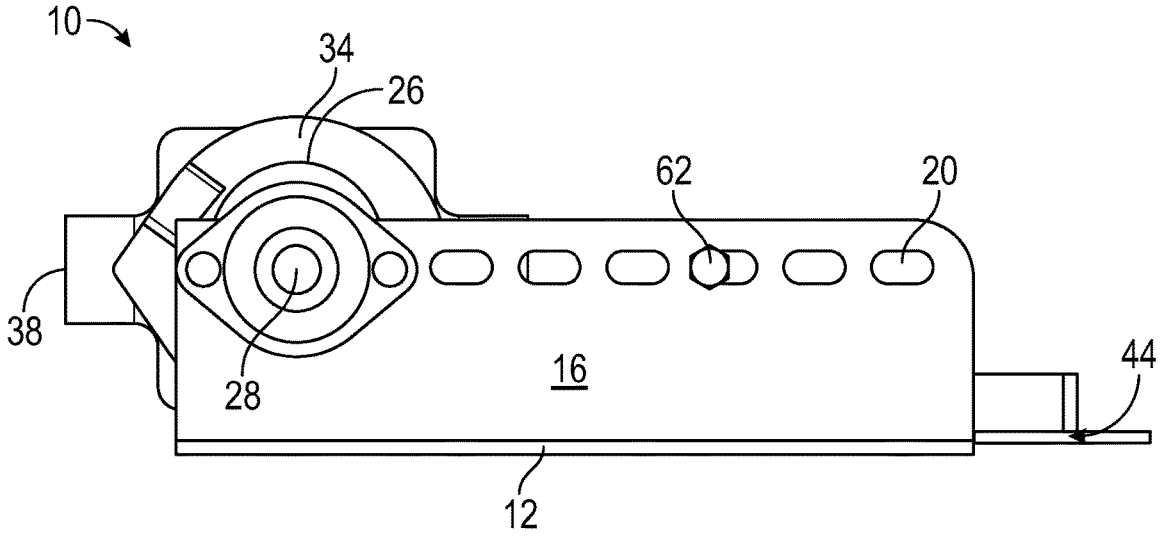

FIGS. 5 and 6 illustrate isometric right and left side views, respectively, of the aquacycle pump (10). In particular, FIG. 5 shows the series of openings (18) along the top portion of the first side wall (14). FIG. 5 further shows the water pump (34) in a fixed position on top of the water pump support plate (32). FIG. 6 shows the series of openings (20) along the top portion of the second side wall (16). FIG. 6 further shows the support bracket (22) supporting the inner shaft (28) of the roller (26), wherein the support bracket (22) includes bearings to assist the inner shaft (28) in rotating freely in the hole of the support bracket (22).

Figure 7:
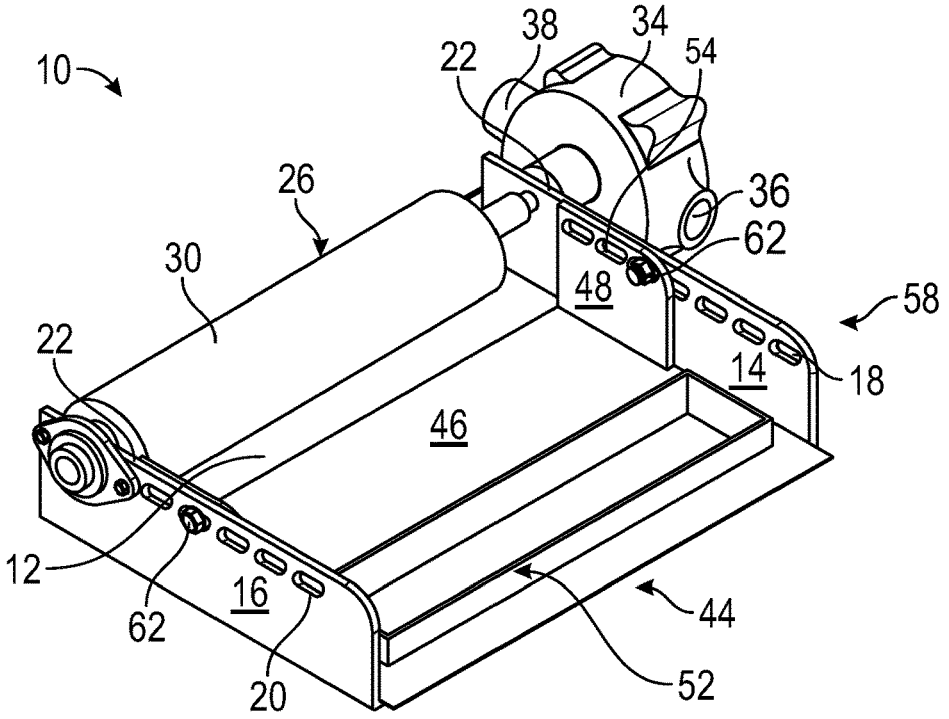
Figure 8:
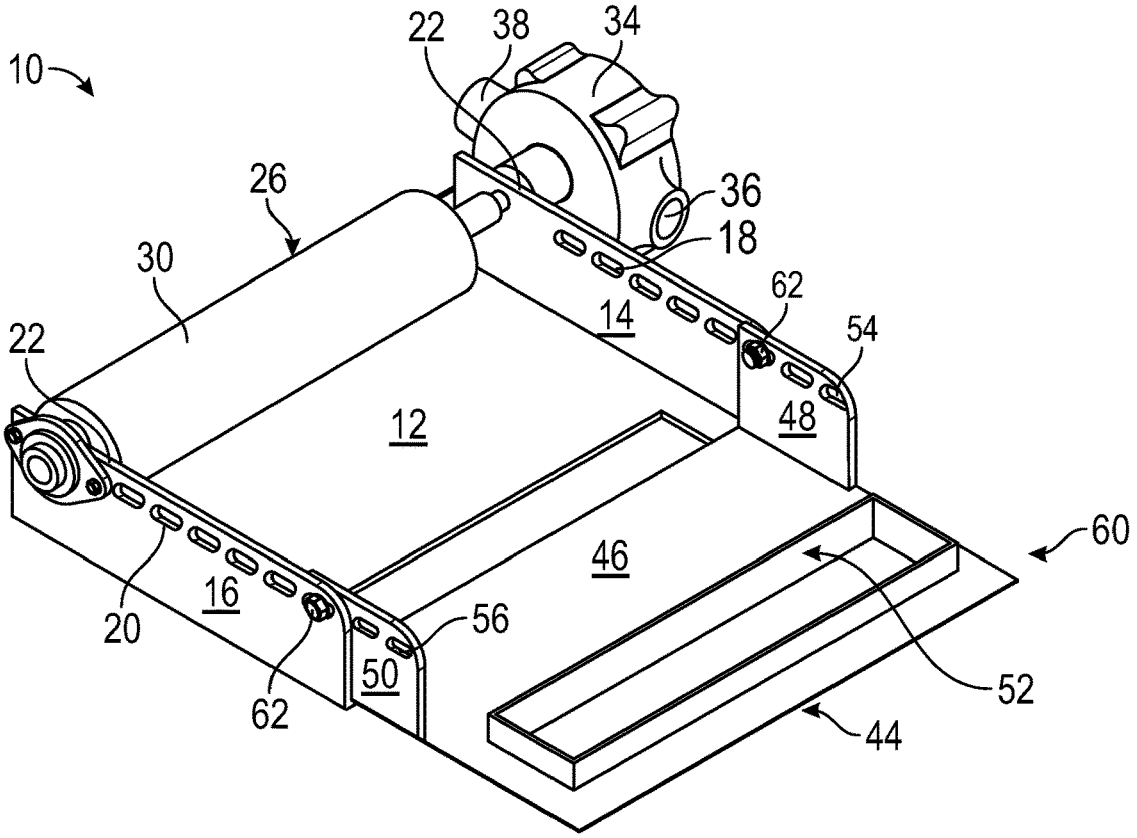

FIGS. 7 and 8 illustrate isometric front-top-left side views of the aquacycle pump (10) in a retracted position and an expanded position, respectively. In particular, FIGS. 1-3, 7-8 show that the aquacycle pump (10) may further comprise a kick-stand support bracket (44). The kick-stand support bracket (44) is configured to secure the aquacycle pump (10) in position, to constrict movement of the aquacycle pump (10) during operation, and to help maintain the roller (26) in contact with the rear wheel of the motorcycle or motorscooter (24).

Shown in FIGS. 7 and 8, the kick-stand support bracket (44) may include a base bracket (46), a first side bracket (48), an opposite second side bracket (50), and a kick-stand holder (52). The first side bracket (48) may have a series of openings (54) along a top portion of the first side bracket (48). The second side bracket (50) may also have a series of openings (56) along a top portion of the second side bracket (50). The series of openings (54) of the first side bracket (48) are configured to correspond to the series of openings (56) of the second side bracket (50). The kick-stand holder (52) may comprise a hole through the base bracket (46), wherein the hole may be surrounded by a physical barrier (e.g., wall, fence, barricade, block, lip, bump-out, ridge, partition, etc.) configured to constrict movement of the aquacycle pump (10) during operation and to help maintain the roller (26) in contact with the rear wheel of the motorcycle or motorscooter (24). In particular, the roller (26) may be pressed against the rear wheel of the motorcycle or motorscooter (24), wherein the outer coating (30) is in contact with the tire. In this position, the kickstand of the motorcycle or motorscooter (24) abuts a front barrier of the kick-stand holder (52), wherein the kickstand is solidly engaged with the ground under the weight of the motorcycle or motorscooter (24). The kickstand when engaged with the ground is configured to not move forward (i.e., towards the front wheel of the motorcycle or motorscooter), only backwards, because of the configuration of the kickstand. The kickstand when engaged with the ground therefore serves as a solid fixture for which the kick-stand holder (52) of the aquacycle pump (10) may abut against to help constrict movement of the aquacycle pump (10) during operation and to help maintain contact between the roller (26) and the rear wheel of the motorcycle or motorscooter (24). The kick-stand holder (52) may also be configured to maintain the motorcycle or motorscooter (24) in a set position after the engine is started, shifted into gear, and throttled to provide power to rotate the rear wheel. The base bracket (46), first and second side brackets (48, 50), and kick-stand holder (52) may be integrally formed together during the manufacturing process, or alternatively, the base bracket (46), first and second side brackets (48, 50), and kick-stand holder (52) may be formed separately during the manufacturing process and then permanently or removably fixed together using welds, glues, screws, bolts, rivets, or other common means of attachment. It is contemplated that base bracket (46), first and second side brackets (48, 50), and kick-stand holder (52) of the aquacycle pump (10) may be comprised of steel, stainless steel, plastics, aluminum or combinations thereof.

Shown in FIGS. 1-3, 7-8, the kick-stand support bracket (44) may be configured to slide on top of the base plate (12) to adjust the aquacycle pump (10) into a retracted position (58) or an expanded position (60), or anywhere in between. In particular, the aquacycle pump (10) may be extended in overall length from approximately 18 centimeters in the retracted position (58) to approximately 45 centimeters in the expanded position (60). The retracted position (58) of the aquacycle pump (10) may be utilized for smaller motorcycles or motorscooters of a shorter overall length. The expanded position (60) of the aquacycle pump (10) may be utilized for larger motorcycles or motorscooters of a longer overall length. The aquacycle pump (10) may be locked (or unlocked) in either the retracted position (58) or the expanded position (60), or anywhere in between, using at least one locking mechanism (62) and the series of openings (18, 20) of the first and second side walls (14, 16) and the series of openings (54, 56) of the first and second side brackets (48, 50). In particular, the series of openings (54) of the first side bracket (48) may be configured to align with the series of openings (18) of the first side wall (14). The series of openings (56) of the second side bracket (50) may also be configured to align with the series of openings (20) of the second side wall (16). The locking mechanism (62) may be utilized to fit into the aligned openings (54, 18) of the first side bracket (48) and first side wall (14). Another locking mechanism (62) may be utilized to fit into the aligned openings (56, 20) of the second side bracket (50) and the second side wall (16). The locking mechanism (62), such as a bolt, screw, clamp, or pin, is configured to effectively lock (and unlock) the kick-stand support bracket (44) in the retracted position (58) or the expanded position (60) for the aquacycle pump (10). Thus, a user may adjust the length of the first and side brackets (48, 50) to engage the roller (26) with the rear wheel of the motorcycle or motorscooter (24) and then lock the first and second side brackets (48, 50) into position using the locking mechanism (62). The kickstand of the motorcycle or motorscooter (24) when engaged with the ground therefore prevents the kick-stand support bracket (44) from moving forward away from the rear wheel of the motorcycle or motorscooter (24) to constrict movement of the aquacycle pump (10) during operation, and to also help maintain contact between the roller (26) and the rear wheel.

Another aspect of the present disclosure is a method of pumping water using the aquacycle pump of FIGS. 1-8. In particular, the method may comprise providing a source of water (e.g., well, reservoir, storage tank, river, lake, etc.) that needs to be conveyed to another location. The method may include providing a motorcycle or motorscooter (24), wherein the motorcycle or motorscooter's (24) ignition is turned off. The motorcycle or motorscooter (24) may include a kick-stand and a rear wheel, wherein the motorcycle or motorscooter (24) is rear-wheel drive. The method may further comprise providing the aquacycle pump (10) of FIGS. 1-8. Depending on the size of the motorcycle or motorscooter (24), the kick-stand support bracket (44) of the aquacycle pump (10) may be adjusted in length and locked into the retracted position (58) or the expanded position (60), or anywhere in between, using the aligned series of openings (18, 20, 54, 56) and the at least one locking mechanism (62) so that the aquacycle pump (10) is compatible in length with the motorcycle or motorscooter. The kick-stand may be set in the kick stand holder (52) to secure the aquacycle pump (10) in position, to constrict movement of the aquacycle pump (10) during operation, and to help maintain contact between the roller (26) and the rear wheel of the motorcycle or motorscooter (24).

The method may comprise placing a rear wheel of the motorcycle or motorscooter (24) in contact with the roller (26) of the aquacycle pump (10). In particular, the tire of the rear wheel of the motorcycle or motorscooter (24) is placed adjacent to and abutting against the outer coating (30) of the roller (26), wherein the tire is effectively resting on top of the roller (26). The method may also include placing one end of the inlet hose into the water source and connecting the other end of the inlet hose to the inlet opening (36) of the water pump (34). One end of the outlet hose may then be connected to the outlet opening (38) of the water pump (34) and the other end of the outlet hose placed at a location where the water is needed, such as to a crop field for irrigation, to a household or business for personal water use, or to a livestock water trough in a pen or pasture. It is contemplated that other locations that need water may also be benefited by the aquacycle pump (10) and method of use of the present disclosure, in addition to the illustrative examples set forth above.

The method may further comprise starting the engine of the motorcycle or motorscooter (24), shifting it into gear, and throttling the engine to provide power to rotate the rear wheel of the motorcycle or motorscooter (24). As the rear wheel rotates, traction between the rear wheel and the outer coating (30) also causes the roller (26) of the aquacycle pump (10) to rotate in unison. The rotating roller (26), in turn, rotates the inner shaft (28) and the water pump shaft (40) coupled together via the shaft coupler (42). The rotating water pump shaft (40) operates the water pump (34) of the aquacycle pump (10) to convey the water to the location where water is needed through the inlet and outlet hoses. For example, with a throttle of the motorcycle or motorscooter (24) set at 1,200 revolutions per minute ("RPM"), the aquacycle pump (10) may transfer approximately 83 liters per minute or 4,980 liters per hour. The method may next include making a determination that enough water has been conveyed by the aquacycle pump (10) to the location where water was needed. After such a determination is made, the method may comprise shifting the motorcycle or motorscooter (24) out of gear and/or turning off the ignition to stop the rear tire from rotating. Once the rear tire stops rotating, consequently, the roller (26) of the aquacycle pump (10) also stops rotating which halts the operation of the water pump (34) and the conveyance of water. The motorcycle or motorscooter (24) may then be removed from the aquacycle pump (10) and used separately for transportation purposes, wherein the aquacycle pump (10) may be conveniently stored until a future conveyance of water is needed.

The aquacycle pump (10) of the present disclosure and method of pumping water using the aquacycle pump (10) are universally applicable to motorcycles and motorscooters (24) of all shapes and sizes, makes, models, and manufacturers. Furthermore, while intended for conveying water, the aquacycle pump (10) and method of pumping water using the aquacycle pump (10) may be used for all types of liquids or fluids commonly conveyed by centrifugal or positive displacement pumps. Although the disclosure has been described and illustrated with respect to preferred aspects thereof, it is not to be so limited since changes and modifications may be made therein which are within the full intended scope of the disclosure.

What is claimed is:

1. An aquacycle pump, comprising:

a base plate;

a first side wall connected to the base plate;

an opposite second side wall connected to the base plate;

the first side wall having a series of openings;

the second side wall having a series of openings;

the first and second side walls each having a support bracket;

a roller comprising:

a) an inner shaft;

b) an outer coating;

c) the outer coating of the roller configured to be in contact with a wheel of a vehicle;

the support brackets configured to support the roller;

a pump support plate connected to either the base plate, the first or second side wall, or a combination of the baseplate and the first or second side wall;

a pump attached to the pump support plate;

the pump comprising a shaft configured to operate the pump;

a shaft coupler configured to couple the inner shaft of the roller to the pump shaft;

a kick-stand support bracket configured to secure the aquacycle pump in position relative to the vehicle;

the kick-stand support bracket comprising:

a) a base bracket;

b) a first side bracket connected to the base bracket;

c) an opposite second side bracket connected to the base bracket;

d) a kick-stand holder;

e) the first side bracket having a series of openings;

f) the second side bracket having a series of openings;

g) the series of openings of the first side bracket configured to align with the series of openings of the first side wall;

h) the series of openings of the second side bracket configured to align with the series of openings of the second side wall;

the aquacycle pump comprising a retracted position and an expanded position to fit different size vehicles;

at least one locking mechanism configured to lock and unlock the aquacycle pump in the retracted position or the expanded position using aligned series of openings; and wherein rotation of the wheel of the vehicle rotates the roller to operate the pump.

2. The aquacycle pump of claim 1, wherein the outer coating of the roller comprises rubber configured to improve traction with a tire of the wheel of the vehicle.

3. The aquacycle of claim 1, wherein the pump is a centrifugal water pump.

4. The aquacycle of claim 1, wherein the kick-stand holder comprises:

a hole through the base bracket;

a physical barrier;

the hole of the base bracket configured to receive a kick-stand of the vehicle; and the physical barrier configured to constrict movement of the aquacycle pump.

5. The aquacycle of claim 1, wherein the vehicle is a motorcycle or motorscooter.

6. The aquacycle of claim 1, wherein the locking mechanism comprises a bolt, screw, clamp or pin.

7. The aquacycle of claim 1, wherein the kick-stand support bracket is configured to slide on top of the base plate to adjust the length of the aquacycle pump.

8. An aquacycle pump, comprising:

a base plate;

a first side wall connected to the base plate;

an opposite second side wall connected to the base plate;

the first and second side walls each having a support bracket;

a roller;

the support brackets configured to support the roller;

a pump support plate connected to either the base plate, the first or second side wall, or a combination of the baseplate and the first or second side wall;

a pump;

the pump attached to the pump support plate;

the pump comprising a shaft configured to operate the pump;

the shaft of the pump coupled to an inner shaft of the roller via a shaft coupler;

a kick stand support bracket;

the kick stand support bracket configured to adjust the aquacycle pump into a retracted position or an expanded position;

the retracted position and the expanded position of the aquacycle pump configured to fit different size vehicles;

the roller configured to be in contact with a wheel of a vehicle; and wherein rotation of the wheel of the vehicle rotates the roller to operate the pump.

9. The aquacycle pump of claim 8, wherein the roller comprises an outer coating;

wherein the outer coating of the roller includes rubber configured to improve traction with a tire of the wheel of the vehicle.

10. The aquacycle pump of claim 8, wherein the kick-stand support bracket is configured to secure the aquacycle pump in position relative to the vehicle.

11. The aquacycle pump of claim 8, wherein the kick-stand support bracket is configured to slide on top of the base plate to adjust the aquacycle pump into the retracted position or expanded position to fit different size vehicles.

12. The aquacycle pump of claim 8, further comprising at least one locking mechanism configured to lock and unlock the aquacycle pump in the retracted position or the expanded position.

13. The aquacycle of claim 8, wherein the pump is a centrifugal water pump.

14. The aquacycle of claim 8, wherein the vehicle is a motorcycle or motorscooter.

15. A method of pumping, comprising:

providing a vehicle;

providing an aquacycle pump, the aquacycle pump comprising:

a) a base plate;

b) a first side wall connected to the base plate;

c) an opposite second side wall connected to the base plate;

d) the first and second side walls each having a support bracket;

e) a roller;

f) the support brackets configured to support the roller; and g) a kick-stand support bracket;

connecting a pump support plate to either the base plate, the first or second side wall, or a combination of the baseplate and the first or second side wall;

providing a pump;

attaching the pump to the pump support plate;

providing a pump shaft for operating the pump;

coupling an inner shaft of the roller to the pump shaft via a shaft coupler;

adjusting the aquacycle pump into a retracted position or an expanded position using the kick-stand support bracket;

the retracted position and the expanded position of the aquacycle pump configured to fit different size vehicles;

locking the aquacycle pump in the retracted position or the expanded position;

securing the aquacycle pump in position relative to the vehicle using the kick-stand support bracket;

placing a wheel of the vehicle in contact with the roller of the aquacycle pump;

rotating the wheel of the vehicle;

the rotation of the wheel of the vehicle causing the roller of the aquacycle pump to rotate; and the rotating roller causing the pump coupled to the roller to operate.

16. The method of claim 15, the vehicle comprising a motorcycle or motorscooter.

17. The method of claim 15, the roller further comprising an outer coating;

wherein the outer coating of the roller is configured to be in contact with the wheel of the vehicle.

18. The method of claim 15, the kick-stand support bracket comprising:

a base bracket;

a first side bracket connected to the base bracket;

an opposite second side bracket connected to the base bracket;

a kick-stand holder comprising a hole through the base bracket and a physical barrier;

the hole of the base bracket configured to receive a kick-stand of the vehicle;

the physical barrier configured to constrict movement of the aquacycle pump; and at least one locking mechanism configured to lock and unlock the aquacycle pump in the retracted position or the expanded position.

19. The method of claim 15, wherein the pump is a centrifugal water pump.

* * * * *